United States Patent [19]

Spain

[11] 4,273,032

[45] Jun. 16, 1981

[54] VENTILATOR APPARATUS

[76] Inventor: Robert C. Spain, Box 728, Frederick, Okla. 73542

[21] Appl. No.: 85,940

[22] Filed: Oct. 18, 1979

[51] Int. Cl.[3] ..... F24F 7/00

[52] U.S. Cl. ..... 98/63

[58] Field of Search ..... 98/8, 9, 10, 11, 32, 98/33, 35, 62, 63, DIG. 2; 4/211, 209, 213; 237/46

[56] References Cited

U.S. PATENT DOCUMENTS

| | | | |
|---|---|---|---|
| 4,392 | 3/1846 | Chase | 98/63 |
| 199,091 | 1/1878 | Morgan . | |
| 209,506 | 10/1878 | Owens . | |
| 644,335 | 2/1900 | Schumacher | 98/63 |
| 1,493,497 | 5/1924 | Otis | 237/46 X |
| 2,704,501 | 3/1955 | Rysdon . | |

*Primary Examiner*—Edward G. Favors
*Assistant Examiner*—Harold Joyce
*Attorney, Agent, or Firm*—Dunlap, Codding & McCarthy

[57] ABSTRACT

An improved ventilator apparatus for venting objectionable odors from a structure, while, at the same time, circulating fresh air through the structure, the ventilator apparatus comprising a vent conduit secured to the structure such that one end portion of the vent conduit is disposed within a lower interior portion of the structure and the opposite end portion extends from the structure and thus establishes fluid communication between the lower interior portion of the structure and the atmosphere, a housing encompassing a portion of the vent conduit, one end portion of the housing being disposed within the structure, the housing having two passageways therein for establishing fluid communication through the housing between an upper interior portion of the structure and the atmosphere, a terminal housing having an inlet and outlet, the terminal housing being rotatably mounted on the vent conduit and the housing such that the inlet of the terminal housing communicates with one of the passageways in the housing and outlet of the terminal housing communicates with the other of the passageways in the housing, and a vane secured to the terminal housing for orienting the terminal housing such that the inlet faces into the wind. A duct assembly is also provided which cooperates with the improved ventilator apparatus for selectively directing air flow into the structure.

43 Claims, 6 Drawing Figures

VENTILATOR APPARATUS

BACKGROUND OF THE INVENTION

1. Field of the Invention

The present invention relates generally to the field of ventilators, and more particularly, but not by way of limitation, to an improved ventilator apparatus for venting objectionable odors from an interior portion of a structure, while, at the same time, circulating fresh air through the interior portion of the structure.

2. Discussion of the Prior Art

Several types of ventilator devices have heretofore been proposed in the prior art for circulating fresh air into a structure, such as a building. Other types of devices have been disclosed for removing foul air from a structure, such as a bathroom. While certain of the proposed devices have been heretofore employed for removing foul odors or circulating air into the structure, problems have nevertheless been encountered in the use of the prior art devices for removing foul air from an interior portion of a structure, while, at the same time, circulating fresh air into the interior portion of the structure without recirculating the foul air being removed therefrom.

SUMMARY OF THE INVENTION

The present invention provides an improved ventilator apparatus for removing objectionable odors from an interior portion of a structure and venting such odors to the atmosphere, while at the same time, enabling air to be circulated into the interior portion of the structure without recirculation of the foul air removed therefrom. In one aspect, the improved ventilator apparatus comprises a substantially vertically disposed vent conduit for establishing fluid communication between a lower interior portion of the structure and the atmosphere, at least an upper portion of the vent conduit being substantially vertically disposed; a housing encompassing a medial portion of the vent conduit, the housing having an outer or first passageway disposed therein and an inner or second passageway disposed therein, the passageways establishing fluid communication between an upper interior portion of the structure and the atmosphere; a terminal housing having an inlet and an outlet, the inlet being positioned in the terminal housing substantially opposite the outlet so that the inlet and outlet face in opposite directions, the terminal housing being rotatably mounted to the portion of the vent conduit extending from the structure such that the terminal housing encompasses the housing and the inlet of the terminal housing openly communicates with one of the passageways of the housing and the outlet of the terminal housing openly communicates with the other of the passageways of the housing; and means secured to the terminal housing for orienting the terminal housing such that the inlet of the terminal housing faces the wind.

In another aspect, the improved ventilator apparatus further comprises a duct assembly operably connected to the housing for establishing fluid communication between the outer or first passageway of the housing with an air return duct; and, the inner or second passageway of the housing with an air inlet duct, the duct assembly adapted to selectively direct air flow through the structure.

The unique arrangement and structure of the improved ventilator apparatus enables objectionable odors to be readily removed from an interior portion of a structure while, at the same time, allowing fresh air to be circulated throughout the structure without recirculation of the removed objectionable odors into the structure.

Accordingly, it is an object of the present invention to provide an improved ventilator apparatus for venting objectionable odors from an interior portion of a structure while enabling air to be simultaneously circulated through the interior portion of the structure.

Another object of the present invention, while achieving the above stated object, is to provide an improved ventilator apparatus that prevents recirculation of foul air removed from the interior portion of the structure.

Another object of the present invention, while achieving the above stated objects, is to provide an improved ventilator apparatus and duct assembly which is economical to manufacture, durable in construction, and can readily be employed on a structure, such as an underground structure, without severe alterations and/or moderations of the structure.

Other objects, advantages and features of the present invention will become apparent to those skilled in the art of ventilation from the reading of the following detailed description when read in conjunction with the accompanying drawings and the appended claims.

BRIEF DESCRIPTION OF THE DRAWINGS

FIG. 6 is a cross sectional view of a second embodiment of the ventilator apparatus of the present invention, the ventilator apparatus operably connected to an improved duct system for selective directing air flow through the interior portion of a structure.

DETAILED DESCRIPTION OF THE INVENTION

Figure 1:
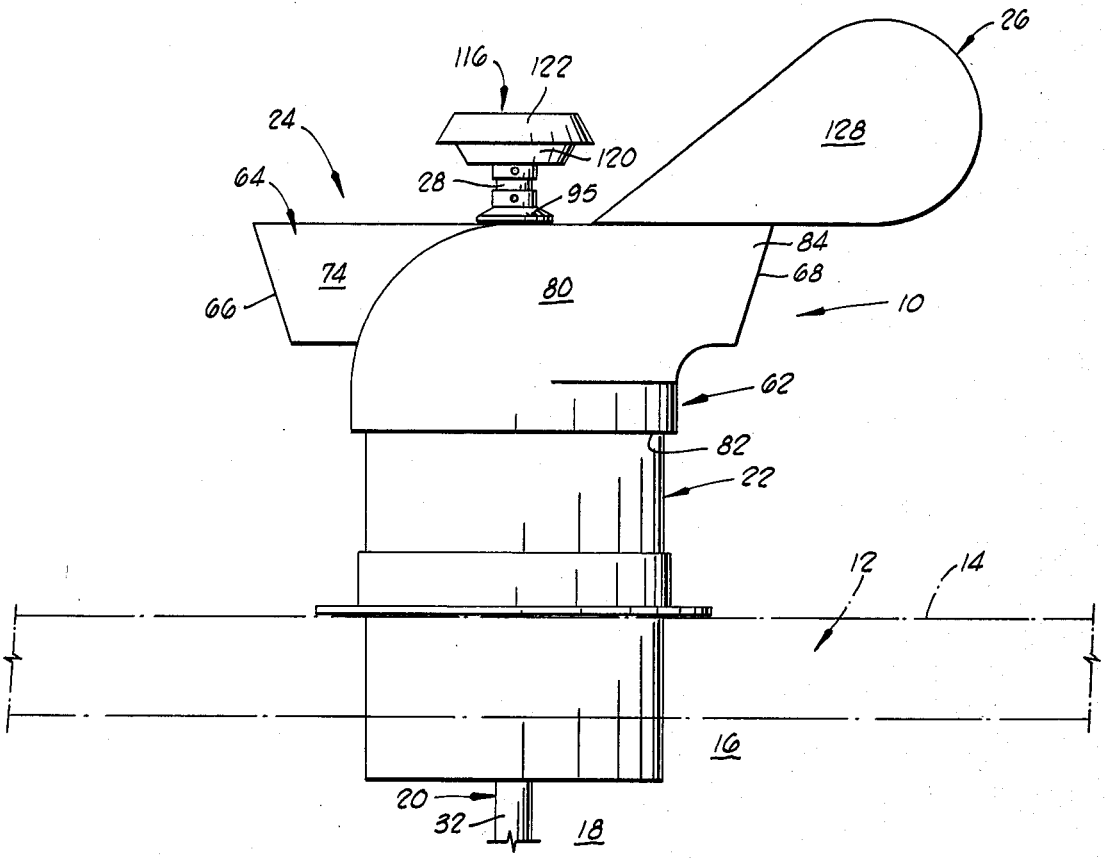
FIG. 1 is a side elevational view of the improved ventilator apparatus of the present invention mounted on the roof of a structure, the structure and roof of same being depicted in phantom.
Figure 2:
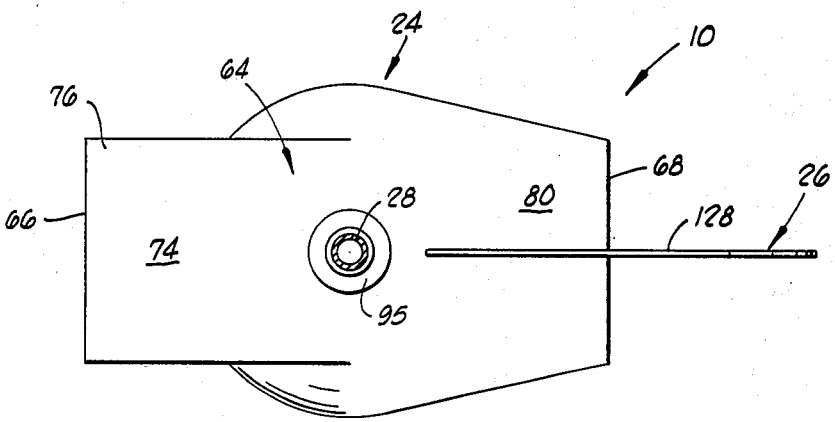
FIG. 2 is a plan view of the ventilator apparatus of the present invention having the cap assembly of the vent conduit removed.

Referring to the drawings, in which like numerals are used to indicate like parts in the various views, and more particularly to FIGS. 1 and 2, a ventilator apparatus 10 is mounted on a structure 12, such as a roof 14 of an underground structure. The structure 12 is provided with an interior portion having a first or upper interior portion 16 and a second or lower interior portion 18. The first or upper interior portion 16 (hereinafter referred to as the upper interior portion) is positioned in close proximity to an interior ceiling (not shown) of the structure, the ceiling containing an air return vent (also not shown). The second or lower interior portion 18 of the interior portion of the structure 12 (hereinafter referred to as the lower interior portion) is to be understood to be an area within the structure, such as a toilet bowl in a bathroom (not shown) or an area adjacent to, or in close proximity to, an odor producing source such as a cooking range, an oven, an indoor charcoal broiler, and the like. The purpose of the division of the interior portion of the structure 12 into the upper interior portion 16 and the lower interior portion 18 will be made apparent hereinafter in the utilization of the ventilator apparatus 10 to remove objectionable odors from the lower interior portion 18 of the structure 12, while at the same time circulating air through the interior portion of the structure 12.

Figure 3:
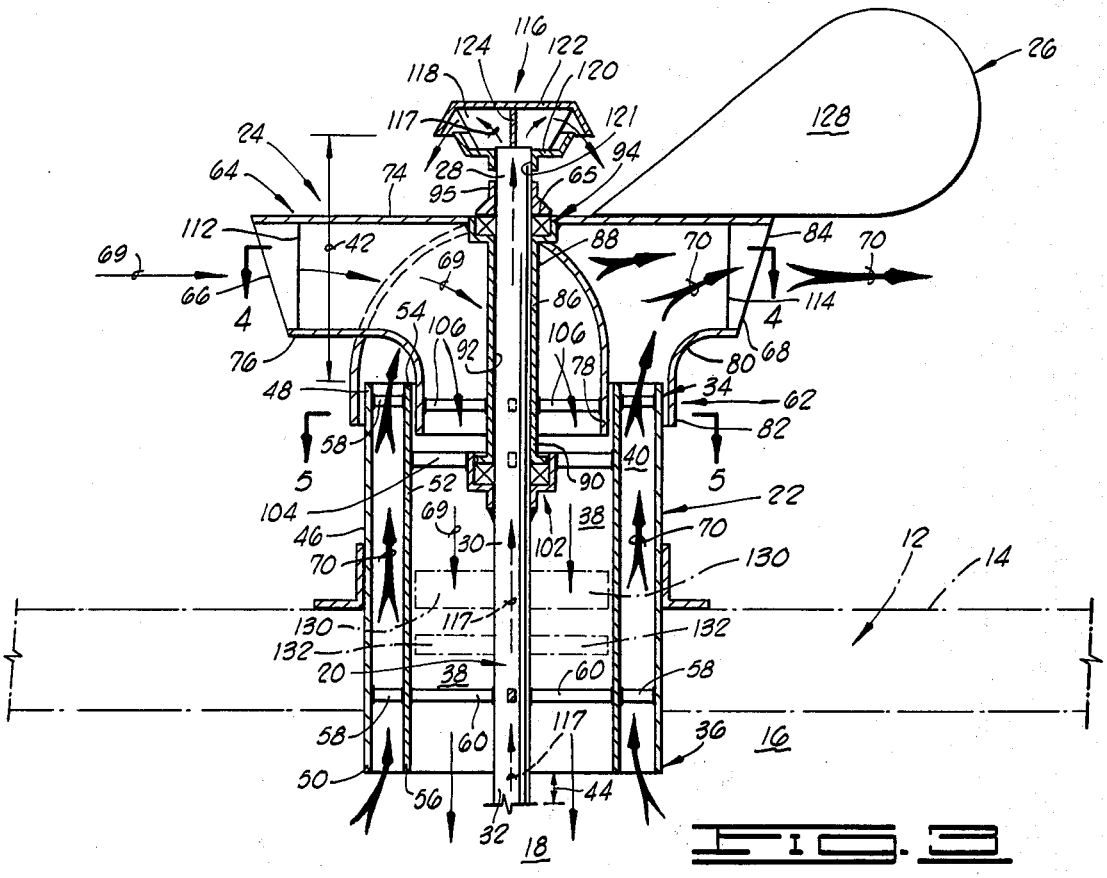
FIG. 3 is a cross sectional view of the ventilator apparatus of FIG. 1 depicting the air flow through the ventilator apparatus.

Referring to FIGS. 1 and 3, the ventilator apparatus 10 comprises a vent conduit 20, a housing 22, a terminal housing 24, and means 26 for orienting the terminal housing 24 in a predetermined relationship with the wind for reasons which will be made more apparent hereinafter. The vent conduit 20 comprises a first end portion 28, a medial portion 30, and a second end portion 32. The vent conduit 20 is vertically disposed with relation to the horizontal plane of the roof 14 of the structure 12. Further, the vent conduit 20 is secured to the structure such that the second end portion 32 of the vent conduit 20 extends into the lower interior portion 18 of the structure 12. The first end portion 28 of the vent conduit 20 extends upwardly from the roof 14 of the structure 12 substantially as shown in the drawings. Thus, the vent conduit 20 establishes fluid communication between the lower interior portion 18 of the structure 12 and the atmosphere, and enables undesirable odors to pass through the vent conduit 20 for removal from the lower interior portion 18 of the structure 12.

Referring now to FIG. 3, the housing 22 of the ventilator apparatus 10 comprises a first end portion 34, a second end portion 36, an axially disposed inner or second passageway 38 (hereinafter referred to as the inner passageway) and an axially disposed outer or first passageway 40 (hereinafter referred to as the outer passageway). The housing 22 is positioned to encompass the medial portion 30 of the vent conduit 20 such that the opposed second end portion 36 of the housing 22 is disposed within the upper interior portion 16 of the structure 12; and, the first end portion 34 of the housing 22 extends upwardly from the roof 14 of the structure 12 as shown. Thus, the inner passageway 38 and the outer passageway 40 of the housing 22 establish fluid communication between the upper interior portion 16 of the structure 12 and the atmosphere outside of the structure. Further, the first end portion 28 of the vent conduit 20 extends a distance 42 from the first end portion 34 of the housing 22; and the second end portion 32 of the vent conduit 20 extends a distance, represented by the distance 44, from the opposed second end portion 36 of the housing 22.

The housing 22 further comprises a first cylindrical housing 46 having a first end portion 48 and an second end portion 50; and a second cylindrical housing 52 having a first end portion 54 and a second end portion 56. The first cylindrical housing 46 is vertically positioned with respect to the structure 12. The first end portion 48 of the first cylindrical housing 46 extends upwardly from the roof 14 of the structure 12 and the second end portion 50 of the first cylindrical housing 46 extends into the upper interior portion 16 of the structure 12 for attachment to an air return duct (as illustrated in FIG. 6).

The second cylindrical housing 52 is coaxially disposed within the first cylindrical housing 46. The second cylindrical housing 52 is secured in a fixed relationship with the first cylindrical housing 46 by a plurality of spider members 58. Thus, the first cylindrical housing 46 (depicted as an outer conduit) is maintained in a spatial relationship with the second cylindrical housing 52 (depicted as an inner conduit) such that the outer passageway 40 is formed therebetween. As previously stated, the outer passageway 40 establishes fluid communication between the upper interior portion 16 of the structure 12 and the atmosphere.

The medial portion 30 of the vent conduit 20 is coaxially disposed within the second cylindrical housing 52 and maintained in a fixed relationship with the second cylindrical housing 52 by a plurality of spider members 60. Thus, the second cylindrical housing 52 is maintained in a spatial relationship with the medial portion 30 of the vent conduit 20 such that the inner passageway 38 is formed therebetween. As previously stated, the inner passageway 38 establishes fluid communication between the upper interior portion 16 of the structure 12 and the atmosphere.

The terminal housing 24 comprises a lower end portion 62 and an upper end portion 64. The terminal housing 24 is rotatably mounted to the first end portion 28 of the vent conduit 20 via the upper end portion 64 such that the lower portion 62 of the terminal housing 24 encompasses the first end portion 34 of the housing 22 (e.g., the first end portion 48 of the first cylindrical housing 46). The upper portion 64 of the terminal housing 24 is provided with an aperture 65 (shown in FIG. 3) so that upon rotatably mounting the terminal housing 24 to the first end portion 28 of the vent conduit 20, as will be more fully described hereinafter, the first end portion 28 of the vent conduit 20 extends upwardly from the upper portion 64 of the terminal housing 24. Thus, the vent conduit 20 establishes fluid communication between the atmosphere and the lower interior portion 18 of the structure 12 so that objectionable odors can be readily removed from the lower interior portion 18 of the structure 12 by air flow (indicated by arrows 59 in FIG. 3) through the vent conduit 20.

Figure 4:
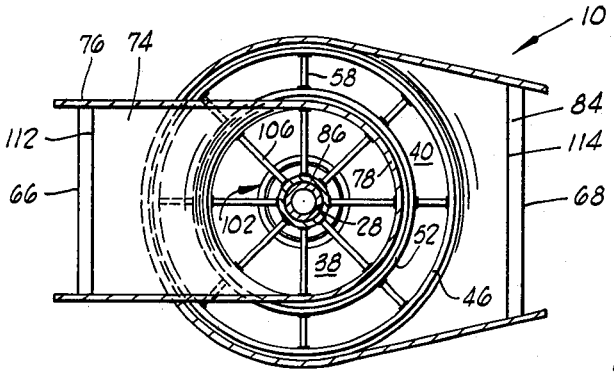
FIG. 4 is a cross sectional view of the ventilator apparatus of FIG. 1 taken along the line 4—4.

As shown in FIGS. 1–4, the terminal housing 24 is further provided with an inlet 66 and an outlet 68. The inlet 66 and the outlet 68 are positioned within the terminal housing 24 such that the inlet 66 and the outlet 68 face in opposite directions and have a common central axis. As shown in FIGS. 3 and 4, the inlet 66 of the terminal housing 24 openly communicates with the inner passageway 38 of the housing 22; and the outlet 68 of the terminal housing 24 openly communicates with the outer passageway 40 of the housing 22. Thus, air flowing into the inlet 66 of the terminal housing 24 (represented in FIG. 3 by arrows 69) is directed through a first portion of the terminal housing 24, through the inner passageway 38 of the housing 22, and into the upper interior portion 16 of the structure 12.

On the other hand, air being removed from the upper interior portion 16 of the structure 12 (the air flow being represented in FIG. 3 by the arrows 70) is directed into the outer passageway 40 of the housing 22, through a second portion of the terminal housing 24, and out the outlet 68 of the terminal housing 24 to the atmosphere.

Figure 5:
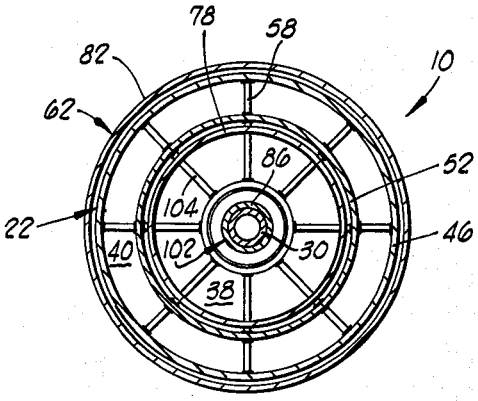
FIG. 5 is a cross sectional view of the ventilator apparatus of FIG. 3 taken along the line 5—5.
Figure 8:
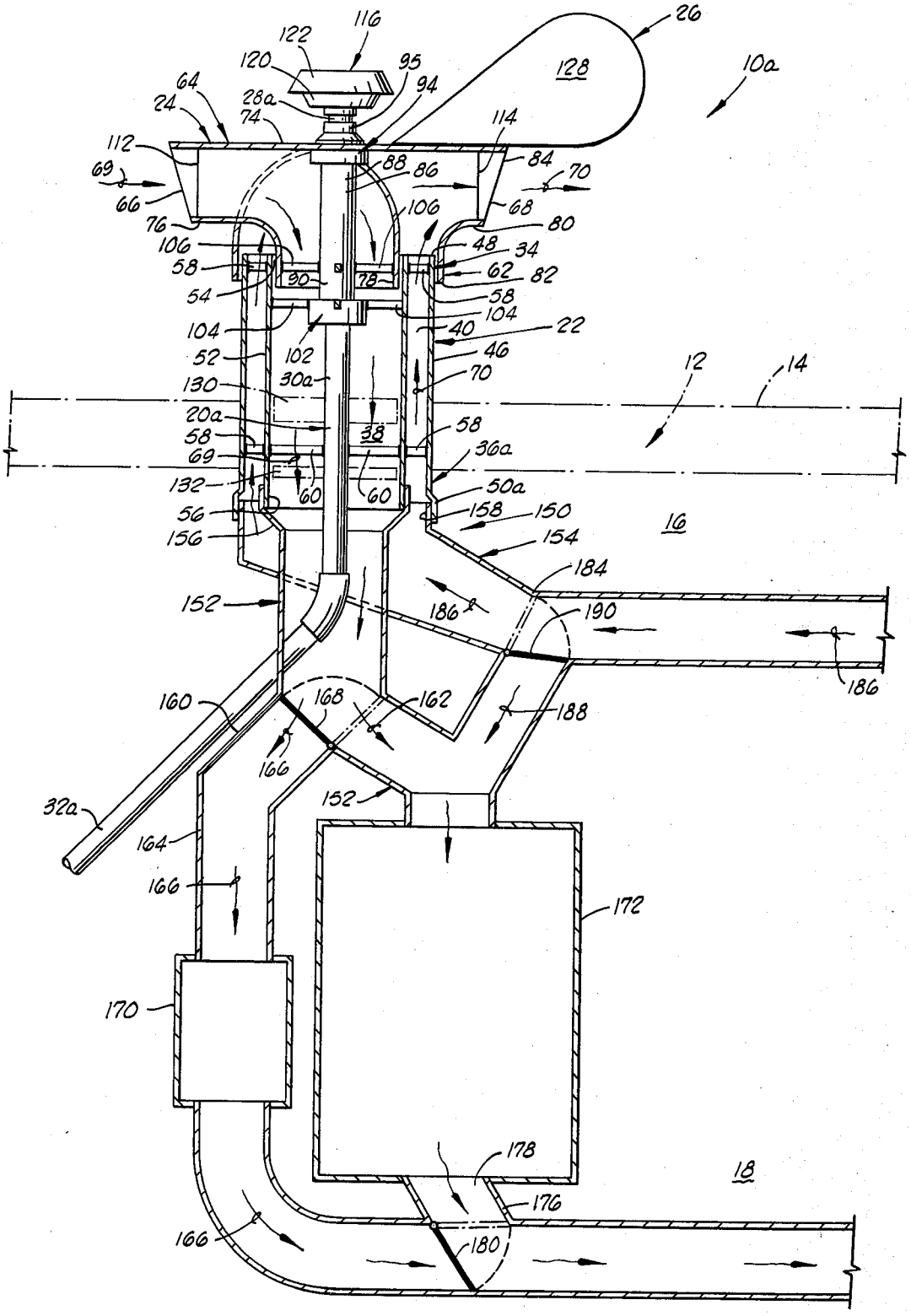

Referring again to FIGS. 1 and 3, the terminal housing 24 comprises a first terminal duct 74 having a first end portion 76 and a second end portion 78; and a second terminal duct 80 having a first end portion 82 and a second end portion 84. The first end portion 76 of the first terminal duct 74 (as depicted in FIGS. 1–4) is provided with a substantially rectangular shaped configuration. The second end portion 78 of the first terminal duct 74 (as depicted in FIGS. 3–5) is provided with a substantially circular configuration. On the other hand, the first end portion 82 of the second terminal duct 80 (as depicted in FIGS. 1, 3 and 5) is provided with a substantially circular configuration; whereas the second end portion 84 of the second terminal duct 80 (as depicted in FIGS. 1–4) is provided with a generally rectangular shaped configuration. Further, the first terminal duct 74 and the second terminal duct 80 each have an elbow configuration.

The second end portion 78 of the first terminal duct 74 is adapted to be positioned within the first end portion 82 of the second terminal duct 80 such that an air flow passageway (FIGS. 3–5) is formed between the second end portion 78 of the first terminal duct 74 and the first end portion 82 of the second terminal duct 80. Thus, air passing through the outer passageway 40 of the housing 22 can pass through the passageway formed between the second end portions 78 of the first terminal duct 74 and the first end portion 82 of the second terminal duct 80 and exit the terminal housing 24 via the outlet 68 of the second terminal duct 80.

Referring now to FIGS. 3 and 4, the terminal housing 24 further comprises a sleeve 86 for rotatably mounting and supporting the terminal housing 24 to the first end portion 28 of the vent conduit 20. The sleeve 86 is provided with a first end portion 88 and an opposed second end portion 90. The sleeve 86 is further provided with a bore 92, the bore 92 being adapted to receive a portion of the vent conduit 20. A first bearing assembly 94 is secured to the first end portion 88 of the sleeve 86 such that the first bearing assembly 94 is operably positioned within the aperture 65 in the upper portion 64 of the terminal housing 24 and secured thereto (the upper portion of the terminal housing 24 where the first terminal duct 74 and the second terminal duct 80 are joined to form the terminal housing 24 as shown in FIG. 3). A thrust collar 95 is secured to the upper end portion 28 of the vent conduit 20 for rotating engagement with the first bearing assembly 94.

Referring specifically to FIG. 3, the location of the first bearing assembly 94 with respect to the sleeve 86, the terminal housing 24, and the vent conduit 20 is more clearly set forth. The first bearing assembly 94 can be any suitable bearing assembly such as a thrust bearing, such bearing assemblies being well known in the art. As depicted, the first bearing assembly 94 is positioned within the aperture 65 in the upper portion 64 of the terminal housing 24. The first bearing assembly 94 which is secured to the first end portion 88 of the sleeve 86, is also secured to the upper portion 64 of the terminal housing 24 surrounding the aperture 65. Further, the first bearing assembly 94 is rotatably positioned around a portion of the first end portion 28 of the vent conduit 20. Thus, the first bearing assembly 94 rotatably mounts the terminal housing 24 and the sleeve 86 in a fixed vertical relationship with the vent conduit 20 and the housing 22.

A second bearing assembly 102 is secured to the medial portion 30 of the vent conduit 20 for rotatably supporting the opposed second end portion 90 of the sleeve 86. A plurality of spider members 104 are operably positioned and secured between the second bearing assembly 102 and the second cylindrical housing 52 to support the second bearing assembly 102 substantially as shown. The second bearing assembly 102 encompasses the vent conduit 20 and is secured thereto by any suitable means, such as welding. The second bearing assembly 102 can be any suitable bearing assembly such as a thrust bearing. Thus, the second bearing assembly 102, in combination with the first bearing assembly 94, cooperates and assists in mounting the terminal housing 24 in a rotatable position upon the vent conduit 20. Further, the first and second bearing assemblies 94, 102, in combination with the sleeve 86 maintain the terminal housing 24 in a rotatable fixed position with respect to the first end portion 34 of the housing 22 substantially as shown in FIG. 3.

To assure proper alignment of the second opposed end portion 90 of the sleeve 86 with the second bearing assembly 102 (as well as to maintain the second end portion 78 of the first terminal duct 74 in a fixed spatial relationship with the sleeve 86 and thus the vent conduit 20), a plurality of spider members 106 are disposed between and secured to the sleeve 86 and the second end portion 78 of the first terminal duct 74.

To prevent insects, debris and other foreign material from entering the interior area of the structure 12 via the inlet 66 or the outlet 68 of the terminal housing 24, a first screen 112 (depicted in FIGS. 3 and 4) is positioned within the first end portion 76 of the first terminal duct 74 and extends the width and height of the inlet 66. A second screen 114 (also depicted in FIGS. 3 and 4) is positioned within the second end portion 84 of the second terminal duct 80 and extends the width and height of the outlet 68 of the second terminal duct 80.

As hereinbefore described, the opposed second end portion 32 of the vent conduit 20 is disposed within the lower interior portion 18 of the structure 12 for attachment to, or for establishing fluid communication with an object producing objectionable odors so that the objectionable odors can be vented to the atmosphere via the vent conduit 20. To retard insects, debris, rain, snow, and other foreign materials from entering the interior of the structure 12 via the vent conduit 20, a cap assembly 116 (depicted in FIGS. 1 and 3) is secured to the first end portion 28 of the vent conduit 20. The cap assembly 116 is constructed such that odors passing upward through the vent conduit 20 (the air flow through the vent conduit being represented in FIG. 3 by the arrows 117) can exit to the atmosphere via a passageway 118 formed in the cap assembly 116.

Referring specifically to FIGS. 1 and 3, the cap assembly 116 comprises a lower body member 120 having an aperture 121 therein and an upper body member 122. The upper body member 122, an enlarged inverted cup shaped member is secured to the lower body member 120, by a plurality of support members, such as support member 124. The lower body member 120, a cup shaped member, is positioned within the inverted cup shaped upper body member 122 and secured therein by the support member 124. Thus, the upper body member 122 is operably connected to the lower body member 120 such that air flow is established through the passageway 118 formed between the upper body member 122 and the lower body member 120. The aperture 121 of the lower body member 120 receives the first end portion 28 of the vent conduit 20 such that in the assembled position the lower body member 120 is secured to the first end portion 28 of the vent conduit 20 substantially as shown in FIGS. 1 and 3.

In order for the ventilator apparatus 10 to function effectively in providing fresh air to the interior portion of the structure 12, it is necessary that the inlet 66 of the terminal housing 24 be positioned to face the wind. Further, to insure that the foul or stale air being withdrawn from the interior portion of the structure 12 is not recirculated through the inlet 66 of the terminal housing 24, the inlet 66 is positioned on an opposite side of the terminal housing 24 from the outlet 68. Thus, the inlet 66 and the outlet 68 of the terminal housing 24 have a common central axis. Further, for effective operation of the ventilator apparatus 10 it is desirable that the central vertical axis of the housing 22 and the vent conduit 20 be substantially perpendicular to the central axis of the inlet 66 and the outlet 68 of the terminal housing 24.

To insure that the inlet 66 of the terminal housing 24 is positioned to face the wind, the means 26 for orienting the terminal housing 24 is secured to the upper portion 64 of the terminal housing 24 near the outlet 68. The means 28 can be any suitable assembly employed for wind orientation of the terminal housing 24, such as a vane 128.

To insure proper operation of the ventilator apparatus 10, even on calm days, a wind generating assembly, such as a fan 130 (depicted schematically in phantom in FIG. 3) is operably positioned and secured within the inner passageway 38 of the housing 22. The fan 130 can be activated to insure an effective flow of fresh air into the structure 12 via the inlet 66 of the first terminal duct 74, and the inner passageway 38 of the housing 22. Further, especially during certain seasons of the year, such as winter, it may be desirable to heat the air being dispersed into the interior portion of the structure 12 via the ventilation apparatus 10. In such instances a heating element 132, (generally represented schematically in phantom in FIG. 3) is operably positioned and disposed within the inner passageway 38 of the housing 22 so that the air passing therethrough can be heated to a desired temperature prior to the air being dispersed into the interior portion of the structure 12. The heating element 132 is positioned a distance from the fan 130 to prevent interference of either the fan 130 or the heating element 132 with the operation of the other. The heating element 132 can be designed for automatic operation by the use of automatic switching devices, thermocouples and the like, such devices being well known in the art.

Referring now to FIG. 6, a modified ventilator apparatus 10*a* is mounted on the structure 12, such as the roof 14 of an underground structure. The structure 12 is provided with an interior portion having the upper interior portion 16 and the lower interior portion 18.

The ventilator apparatus 10*a* comprises a vent conduit 20*a*, the housing 22, the terminal housing 24, and the means 26 for orienting the terminal housing in a predetermined relationship with the wind. The vent conduit 20*a* comprises a first end portion 28*a*, a medial portion 30*a*, and a second end portion 32*a*. The first end portion 30*a* and an upper portion of the medial portion 30*a* of the vent conduit 20*a* are vertically disposed with relation to the horizontal plane of the roof 14 of the structure 12. Further, the vent conduit 20*a* is secured to the structure 12 such that the second end portion 32*a* of the vent conduit 20*a* extends into the lower interior portion 18 of the structure 12 and is operably connected to the odor producing source, such as a toilet bowl in the bathroom. The first end portion 28*a* of the conduit 20*a* extends upwardly from the roof 14 of the structure 12 substantially as shown in FIG. 6. Thus, the vent conduit 20*a* establishes fluid communication between the odor producing source in the lower interior portion 18 of the structure 12 and the atmosphere so that undesirable odors can be passed through the vent conduit 20*a* and removed from the interior portion of the structure 12.

The housing 22 of the ventilator apparatus 10*a* comprises (as hereinbefore described with reference to FIGS. 1–5) the first end portion 34, an opposed second end portion 36*a*, the axially disposed inner passageway 38, and the axially disposed outer passageway 40. The housing 22 encompasses a portion of the medial portion 30*a* of the vent conduit 20*a* such that the opposed second end portion 36*a* of the housing 22 is disposed within the upper interior portion 16 of the structure 12 and is operably connected to and establishes fluid communication with a duct assembly 150. The first end portion 34 of the housing 22 extends upwardly from the roof 14 of the structure 12 substantially as shown. Thus, the inner passageway 38 and the outer passageway 40 of the housing 22 can establish fluid communication between the interior portion of the structure 12 and the atmosphere outside the structure 12 via the duct assembly 150.

The first end portion 28*a* of the vent conduit 20*a* extends a distance from the first end portion 34 of the housing 22; the medial portion 30*a* of the vent conduit 20*a* extends through a sidewall of the duct assembly 150 such that the opposed second end portion 32*a* of the vent conduit 20*a* can be connected to the odor producing source.

The housing 22 further comprises the first cylindrical housing 46 having the first end portion 48 and an opposed second end portion 50*a*; the second cylindrical housing 52 having the first end portion 54 and the second end portion 56. The first cylindrical housing 46 is vertically positioned with respect to the structure 12 such that the first end portion 48 of the first cylindrical housing 46 extends upwardly from the roof 14 of the structure 12 and the opposed second end portion 50*a* of the first cylindrical housing 46 extends into the upper interior portion 16 of the structure 12 for attachment to an air return duct 154 of the duct assembly 150.

The second cylindrical housing 52 is coaxially disposed within the first cylindrical housing 46 and secured in a fixed relationship therewith by a plurality of the spider members 58. Thus, the first cylindrical housing 46 is maintained in a spatial relationship with the second cylindrical housing 52 such that the outer passageway 40 is formed therebetween. The second end portion 56 of the second cylindrical housing 52 extends into the upper interior portion 16 of the structure 12 for attachment to an air inlet duct 152 of the duct assembly 150.

At least a portion of the medial portion 30*a* of the vent conduit 20*a* is coaxially disposed within the second cylindrical housing 52 such that the inner passageway 38 is formed therebetween. The vent conduit 20*a* is maintained in a fixed relationship with the second cylindrical housing 52 by the spider members 60.

The terminal housing 24 comprises the lower end portion 62 and the upper end portion 64. The terminal housing 24 is rotatably mounted to the first end portion 28*a* of the vent conduit 20*a* via the upper end portion 64 such that the lower end portion 62 of the terminal housing 24 encompasses the first end portion 48 of the first cylindrical housing 46 of the housing 22. The upper end portion 64 of the terminal housing 24 is provided with an aperture (not shown) so that upon rotatably mounting the terminal housing to the first end portion 28*a* of the vent conduit 20*a* the first end portion 28*a* of the vent conduit 20*a* extends upwardly from the upper portion 64 of the terminal housing 24. The combination of the terminal housing 24, the housing 22, the duct assembly 150, and the vent conduit 20a enables objectionable odors to be vented from the structure 12 via the vent conduit 20a while, at the same time, allowing air to be passed through the terminal housing 24 and the housing 22 into the structure 12 via the duct assembly 150.

As heretofore stated with reference to FIGS. 1–4, the inlet 66 and the outlet 68 of the terminal housing 24 are positioned substantially opposite each other and have a common central axis. The inlet 66 of the terminal housing 24 openly communicates with the inner passageway 38 formed between the vent conduit 20a and the second cylindrical housing 52; the outlet 68 of the terminal housing 64 openly communicates with the outer passageway 40 formed between the first cylindrical housing 46 and the second cylindrical housing 52. The inner passageway 38 fluidly communicates with the inlet duct 152 of the duct assembly 150 for directing air into the structure 12; whereas, the outer passageway 40 fluidly communicates with the air return duct 154 of the duct assembly 150 for removing air from the interior portion of the structure 12. The flow of air through the terminal housing 24, inner passageway 38 of the housing 22 (and thus into the air inlet duct 152 of the duct assembly 150) is represented by the arrows 69; and, the air flow from the interior portion of the structure 12 (via the air return duct 152 of the duct assembly 150), the outer passageway 40 of the housing 22 and the terminal housing 24 is represented by the arrows 70.

As previously stated with reference to FIGS. 1 and 3, the terminal housing 24 (as depicted in FIG. 6 also) comprises the first terminal duct 74 and the second terminal duct 80. The first terminal duct 74 is provided with the first end portion 76 and the second end portion 78; and the second terminal duct 80 is provided with the first end portion 82 and the second end portion 84. The first end portion 76 of the terminal duct 74 has a substantially rectangular configuration whereas the opposed second end portion 78 has a substantially circular configuration. On the other hand, the first end portion 82 of the second duct 80 has a substantially circular configuration and the second end portion 84 has a generally rectangular shaped configuration. Further, the first terminal duct 74 and the second terminal duct 80 each have an elbow configuration.

The first terminal duct 74 and the second terminal duct 80 are constructed such that the second end portion 78 of the first terminal duct is positioned within the first end portion 82 of the second terminal duct 80 and an air flow passageway is formed therebetween (see FIGS. 3–5). Thus, air passing through the outer passageway 40 of the housing 22 can exit the outlet 68 of the second terminal duct 80 via the passageway formed between the second end portion 78 of the first terminal duct 74 and the first end portion 82 of the second terminal duct 80.

The terminal housing 24 further includes the sleeve 86. The sleeve 86 rotatably mounts and supports the terminal housing 24 on the first end portion 28a of the vent conduit 20a. The sleeve 86 is provided with the first end portion 88 and the opposed second end portion 90. The sleeve 86 is further provided with a bore (not shown) for receiving a portion of the vent conduit 20a. The first bearing assembly 94 is secured to the first end portion 88 of the sleeve 86. The first bearing assembly 94 is positionable within an aperture (not shown) in the upper portion 64 of the terminal housing 24 such that the first bearing assembly 94 can be secured to the terminal housing 24. The thrust collar 95 is secured to the upper end portion 28a of the vent conduit 20a for rotating engagement with the first bearing assembly 94. The first bearing assembly 94, which is rotatably positioned around a portion of the first end portion 28a of the vent conduit 20a rotatably mounts the terminal housing 24 and the sleeve 86 in a fixed vertical relationship with the vent conduit 20a and the housing 22. The first bearing assembly 94 can be any suitable bearing assembly, such as a thrust bearing. Such bearing assemblies are well known in the art.

The second bearing assembly 102 is secured to the medial portion 30a of the vent conduit 20a for rotatably supporting the opposed second end portion 90 of the sleeve 86. The spider members 104 are positioned between the second bearing assembly 102 and the second cylindrical housing 52 to support the second bearing assembly 102. Further, the second bearing assembly 102 (which encompasses a portion of the vent conduit 20a) can be secured to the vent conduit 20a by any suitable means, such as welding. Thus, the second bearing assembly 102, in combination with the first bearing assembly 94, cooperates and assists in mounting the terminal housing 24 in a rotatable position upon the vent conduit 20a. Further, the first and second bearing assemblies 94, 102, in combination with the sleeve 86, maintain the terminal housing 24 in a rotatable fixed position with respect to the first end portion 34 of the housing 22. The second bearing assembly 102 can be any suitable bearing assembly, such as a thrust bearing.

The spider members 106 are disposed between and secured to the sleeve 86 and the second end portion 78 of the first terminal duct 74. The spider members 106 assure a proper alignment of the second opposed end portion 90 of the sleeve 86 with the second bearing assembly 102. Further, the spider members 106 maintain the second end portion 78 of the first terminal duct 74 in a fixed, spatial relationship with the sleeve 86 and thus the vent conduit 20a.

The terminal housing 24 is further provided with the first screen 112 and the second screen 114 to prevent insects, debris and other foreign materials from entering the interior portion of the structure 12 via the inlet 66 or the outlet 68 of the terminal housing 24. The first screen 112 is positioned within the first end portion 76 of the first terminal duct 74 and extends the width and height of the inlet 66. The second screen 114 is positioned within the second end portion 84 of the second terminal duct 80 and extends the width and height of the outlet 68 of the second terminal duct 80.

As hereinbefore described, the opposed second end portion 32a of the vent conduit 20a is disposed within the lower interior portion 18 of the structure 12 for attachment to, and for establishing fluid communication, with the object producing objectionable odors so that the objectionable odors can be vented to the atmosphere via the vent conduit 20a. To retard insects, debris, rain, snow and other foreign materials from entering the vent conduit 20a, the cap assembly 116 (described in more detail heretofore with reference to FIGS. 1 and 3) is secured to the first end portion 28a of the vent conduit 20a. As previously stated, the cap assembly 116 is constructed such that odors passing through the vent conduit 20a can exit to the atmosphere via the passageway (not shown) formed in the cap assembly 116.

The cap assembly 116 comprises the lower body member 120 and the upper body member 122. The upper body member 122, an enlarged inverted cup-shaped member, is secured to the lower body member 120 by a plurality of support members, see FIG. 3. The lower body member 120, also a cup-shaped member, is positioned within the inverted cup-shaped upper body member 122 and secured therein by the support members. Thus, the upper body member 122 is operably connected to the lower body member 120 such that a passageway is formed therebetween so that air flow can be established through the passageway. Further, the lower body member 120 is provided with an aperture (not shown) for receiving the first end portion 28*a* of the vent conduit 20*a* such that in the assembled position the lower body member 120 is secured to the first end portion 28*a* of the vent conduit 20*a*.

As previously stated, to insure that foul or stale air being removed from the interior portion of the structure 12 is not recirculated through the inlet 66 of the terminal housing 24, the inlet 66 of the terminal housing 24 is positioned on an opposite side of the terminal housing 24 from the outlet 68. To further insure that the foul or stale air is not recirculated into the structure the inlet 66 of the terminal housing 24 should be positioned to face the wind. To insure that the inlet 66 of the terminal housing 24 is positioned to face the wind, the means 26 for orienting the terminal housing 24 is secured to the upper portion 64 of the terminal housing 24 near the outlet 68. The means 26 can be any suitable assembly employed for wind orientation of the terminal housing 24, such as the vane 128. Further, for effective operation of the ventilator apparatus 10*a*, it is desirable that the central vertical axis of the housing 22 (and the portion of the vent conduit 20*a* disposed within the vertical housing 22 and extending upwardly from the vertical housing 22) be substantially perpendicular to the central axis of the inlet 66 and the outlet 68 of the terminal housing 24.

To provide air circulation throughout the interior portion of the structure 12, even on calm days, the fan 130 (depicted schematically in phantom) is operably positioned and secured within the inner passageway 38 of the housing 22. The fan 130 can be activated to insure an effective flow of fresh air into the structure via the inlet 66 of the first terminal duct 74, the inner passageway 38 of the housing 22, and the air inlet duct 152 of the duct assembly 150. Further, especially during certain seasons of the year, such as winter, it may be desirable to heat the air being disbursed into the interior portion of the structure 12 via the ventilation apparatus 10*a* and the air inlet duct 152 of the duct assembly 150. In such instances, the heating element 132 (generally represented schematically in phantom) is operably positioned and disposed within the inner passageway 38 of the housing 22 so that air passing therethrough can be heated to a desired temperature prior to the air being disbursed into the interior portion of the structure 12 via the air inlet duct 152. The heating element 132 is positioned a distance from the fan 130 to prevent interference of either the fan 130 or the heating element 132 with the operation of the other. The heating element 132 can be designed for automatic operation by the use of automatic switching devices, thermocouples and the like, such devices being well known in the art.

The duct assembly 150 is secured to the lower end portion 36*a* of the housing 22 by any suitable means, as long as the air inlet duct 152 of the duct assembly 150 is in fluid communication with the inner passageway 38 of the housing 22 of the ventilator apparatus 10*a*; and the air return duct 154 of the duct assembly 150 is in fluid communication with the outer passageway 40 of the housing 22 of the ventilator apparatus 10*a*.

As previously indicated, the duct assembly 150 comprises the air inlet duct 152 and the air return duct 154. The air inlet duct 152 is provided with a first end portion 156 and a second end portion (not shown). The first end portion 156 of the air inlet duct 152 is connected to the second end portion 56 of the second cylindrical housing 52 of the housing 22 such that fluid communication is established between the inner passageway 38 of the housing 22 and the air inlet duct 152. The second end portion (not shown) of the air inlet duct 152 is operably connected to an air delivery vent (not shown) in the structure 12. The air delivery vent is located within the structure 12 such that it openingly comunicates with the lower interior portion 18 of the structure 12. Such air delivery vents and the attachment of the air inlet duct 152 to the air delivery vent is well known in the art.

The air return duct 154 is likewise provided with a first end portion 158 and a second end portion (not shown). The first end portion 158 of the air return duct 154 is operably disposed in the flanged portion of the opposed second end portion 36*a* of the housing 22 (i.e., the opposed second end portion 50*a* of the first cylindrical housing 46) such that fluid communication is established between the outer passageway 40 of the housing 22 and the air return duct 154. The second end portion (not shown) of the air return duct 154 is attached to an air return vent (not shown) in the structure 12. The air return vent is located within the structure 12 such that it openingly communicates with upper interior portion 18 of the structure 12. Such air return vents and the attachment of the air return duct 154 to such vents well known in the art.

The duct assembly 150 further comprises a first manifold 160, a by pass duct 164, and a second manifold 176. The first manifold 160 is operably disposed in the air inlet duct 152 (as shown in FIG. 6) and establishes fluid communication with the by pass duct 164. Thus, the first manifold 160 directs the air flow through the air inlet duct 152 along a primary air flow path represented by the arrows 162, or through the by pass duct 164 along a secondary air flow path represented by the arrows 166. To selectively control the air flow through the air inlet duct 152 or the by pass duct 164, a first damper assembly 168 is operably disposed within the first manifold 160. The first damper assembly 168 is movable between a first position and a second position. When the first damper assembly 168 is in the first position the air flow is directed through the air inlet duct 152 along the primary air flow path represented by the arrows 162. However, when the first damper assembly 168 is in the second position (as illustrated in phantom in FIG. 6) the air flow is directed into and through the by pass duct 164 and along the second air flow path represented by the arrows 166. A filter unit 170 is operably disposed in the by pass duct 164 for filtering the air passing therethrough to remove dust, particles, and other particulate matter from the air flowing through the by pass duct 164 prior to the air being dispersed into the structure 12 as will more clearly be set forth hereinafter.

An air conditioning unit 172 (having an air inlet 174 and an air outlet 178) is operably connected to and in fluid communication with the air inlet duct 152 at a position between the first manifold 160 and the air delivery vent (not shown) disposed within the structure 12. The air inlet duct 152 is operably connected to the air inlet 174 of the air conditioning unit such that the air flow is through the air conditioning unit 172, along primary air flow path represented by the arrows 162, when the first damper assembly 168 is in the first position. The term "air conditioning unit" as used herein is to be understood to include a heating and cooling unit for controlling the temperature of the air supplied to the structure 12. Such units are conventional in the art and include filters and the like.

The second manifold 176 is operably connected to the air outlet 178 of the air conditioning unit 172 and the by pass duct 164. The second manifold 176, in combination with the first manifold 160, establishes fluid communication between the air inlet duct 152 (via the air conditioning unit 172) and the by pass duct 164. A second damper assembly 180 is operably disposed within the second manifold 176. The second damper assembly 180 is movable between a first position and a second position. When the second damper assembly 180 is in the first position the by pass duct 164 is substantially closed off. However, when the second damper assembly 180 is in the second position (as illustrated in phantom in FIG. 6) the air outlet 178 of the air conditioning unit 172 is substantially closed off and the by pass duct 164 is in open, fluid communication with the air inlet duct 152 (provided the first manifold 160 is also in the second position as will more fully be described hereinafter).

The air return duct 154 is, as previously stated, provided with a first end portion 158 (which is operably disposed in the flange portion of the opposed second end portion 36*a* of the housing 22) and the second end portion (not shown). The second end portion of the air return duct 154 is connected to an air return vent (not shown) in the structure 12. A third manifold 184 is operably disposed in the air return duct 154. The third manifold 184 is adapted to direct the air flow through the air return duct 154 along a first air flow path represented by the arrow 186 to the atmosphere via the outer passageway 40 of the housing 22 and the outlet 68 of the terminal housing 24; or along a second air flow path 188 so that the air is recirculated into the structure 12 via the air inlet duct 152, the air conditioning unit 172, and the second manifold 176.

A third damper assembly 190 is operably disposed within the third manifold 184. The third damper assembly 190 is movable between a first position and a second position. When the third damper assembly 190 is in the first position the air flow through the return duct 154 is vented to the atmosphere via the return duct 154 (along the air flow path 186) and the ventilator apparatus 10*a* (along the air flow path 70). When the third damper assembly 190 is in the second position (shown in phantom in FIG. 6) the air flow through the air return duct 154 is along the second air flow path represented by the arrow 188 for recirculation to the interior portion of the structure 12 via the air conditioning unit 172 and the air inlet duct 152. It should be noted that the first damper assembly 168, the second damper assembly 180, and the third damper assembly 190 are operably interconnected such that the air flow through the structure 12 can be selectively passed along predetermined air flow paths through the duct assembly 150 and the ventilator apparatus 10*a* as will be more fully illustrated by the following conditions. It should further be noted that in the following explanation of the operation of the damper assemblies 168, 180, 190, to direct the air flow through the duct assembly 150, will generally be dependent upon wind and temperature conditions.

Condition No. 1

Mild Wind Conditions and Mild Temperature

Air is delivered by the wind force into the first end portion 76 of the first terminal duct 74 and flows through the inner passageway 38 of the housing 22 and into the air inlet duct 152 of the duct assembly 150. The first damper assembly 168 is in the second position and thus directs the air flow into the by pass duct 164 and along the air flow path represented by the arrows 166. The second damper assembly 180 is in its second position (illustrated in phantom) so as to close off the air outlet 178 of the air conditioning unit 172 and allow the air flow through the by pass duct 164 to pass through the air inlet duct 152 into the interior portion of the structure 12. The air return from the structure 12 is via the air return duct 154. The third damper assembly 190 is in its first position so that the air passing through the air return duct along the air flow path 186 is directed through the outer passageway 40 of the housing 22 and exits to the atmosphere via the outlet 68 of the second terminal duct 80.

Condition No. 2

Mild Temperatures and Substantially No Wind

The fan 130 of the ventilator apparatus 10 is activated so that air is pulled into the inlet 66 of the terminal housing 24. The first damper assembly 168 is moved to its second position (illustrated in phantom) so that the air is directed along the secondary air flow path represented by the arrows 166 and into the by pass duct 164. The second damper assembly 180 is moved to its second position (also illustrated in phantom) so that the air conditioner unit 172 is closed off. Thus the by pass duct 164 opening communicates with the air inlet duct 152 for delivery of the air into the interior portion of the structure 12. The air removed from the interior portion of the structure 12 is passed through the air return duct 154 along the air flow path 186 and into the outer passageway 40 of the terminal housing 24 along the air flow path 70 so that the air is exited to the atmosphere via the outlet 68 of the terminal housing 24. Such is accomplished by maintaining the third daper assembly 190 in the first position.

Condition No. 3

The Temperature of the Outside Air is Either Extremely Hot or Cold

In this condition one does not desire delivery of outside air into the interior portion of the structure 12. In this condition the first damper assembly 168 is moved to the second position (shown in phantom) so that the air flow from the ventilator apparatus 10*a* is substantially closed off. The second damper assembly 180 is moved to the first position so that the by pass duct 164 is also closed off. The third damper assembly 190 is moved to the second position (shown in phantom) so that the ventilator apparatus 10*a* is substantially closed off with respect to the air return duct 154. Thus, the air is recirculated through the structure 12 via the air inlet duct 152, the air conditioner unit and the air return duct 154.

Any suitable damper assembly can be employed as the first, second and third damper assemblies 168, 180 and 190. Further, the first, second and third damper assemblies 168, 180 and 190 can be interconnected and operated by electric motors, and the like. Such damper assemblies are well known in the art. Thus, no further detail as to the damper assemblies and their structure is believed necessary.

While the subject invention has been described in terms of certain preferred embodiments, and illustrated by certain drawings, such are intended for illustrative purposes only and alternatives or equivalents may readily occur to those skilled in the art without departing from the scope and spirit of the invention as set forth in the appended claims.

What is claimed is:

1. A ventilator apparatus for venting objectionable odors from an interior area of a structure to the atmosphere and for providing air circulation in the structure, the interior area of the structure having a first interior portion and a second interior portion, the ventilator apparatus comprising:

a vent conduit having a first end portion, a medial portion, and a second end portion, the vent conduit being secured to the structure such that the first end portion and the medial portion of the vent conduit are substantially vertically disposed and the second end portion is disposed within the first interior portion of the structure, the first end portion of the vent conduit extending upwardly from the structure, the vent conduit establishing fluid communication between the first interior portion of the structure and the atmosphere;

a housing having a first end portion and an opposed second end portion, the opposed end portion of the housing being disposed within the second interior portion of the structure and the first end portion of the housing extending upwardly from the structure, the housing encompassing the medial portion of the vent conduit such that the first end portion of the vent conduit extends a distance from the first end portion of the housing and the second end portion of the vent conduit extends a distance from the opposed second end portion of the housing, the housing being further characterized as having an axially disposed inner passageway and an axially disposed outer passageway therein, the inner and the outer axially disposed passageways establishing fluid communication between the second interior portion of the structure and the atmosphere;

a terminal housing having an inlet and an outlet, the inlet being positioned in the terminal housing substantially opposite the outlet such that the inlet and outlet face in opposite direction, the terminal housing being rotatably mounted to the first end portion of the vent conduit and encompassing the first end portion of the housing such that in an assembled position the vent conduit communicates with the atmosphere, the inlet of the terminal housing communicating with one of the inner and the outer axially disposed passageways of the housing and the outlet of the terminal housing communicating with the other of the inner and the outer axially disposed passageways, the inlet and outlet of the terminal housing having a common central axis, the central axis being substantially perpendicular to a vertical axis of the vent conduit disposed with the housing; and means secured to the terminal housing for orienting the terminal housing such that the inlet of the terminal housing faces the wind.

2. The ventilator apparatus of claim 1 wherein the housing comprises:

an inner conduit and an outer conduit, the inner and outer conduits being maintained in a spatial relationship with each other such that the inner conduit and the vent conduit define the axially disposed inner passageway of the housing, and the inner conduit and the outer conduit define the axially disposed outer passageway of the housing.

3. The ventilator apparatus of claim 2 wherein the terminal housing comprises:

a first terminal duct having a first end portion and a second end portion, the first end portion having the inlet positioned therein, the second end portion being disposed within an upper portion of the axially disposed inner passageway of the housing; and a second terminal duct having a first end portion and a second end portion, the first end portion having the outlet positioned therein, the second end portion encompassing an upper end portion of the outer conduit of the housing.

4. The ventilator apparatus of claim 2 which further comprises a plurality of first spider members disposed between and secured to the vent conduit and the inner conduit of the housing for maintaining the inner conduit in a predetermined spatial relationship with the vent conduit.

5. The ventilator apparatus of claim 4 which further comprises a plurality of second spider members disposed between and secured to the inner conduit of the housing and the outer conduit of the housing for maintaining the outer conduit in a predetermined spatial relationship with the inner conduit.

6. The ventilator apparatus of claim 5 wherein the terminal housing further comprises a sleeve having a first end portion, an opposed second end portion, and a bore, the sleeve being vertically disposed within the first terminal duct of the terminal housing such that in the assembled position of the first end portion of the vent conduit is positioned within the bore of the sleeve and extends outwardly from the first end portion of the sleeve.

7. The ventilator apparatus of claim 6 wherein the terminal housing further comprises a first bearing means secured to the first end portion of the sleeve for rotatably mounting and supporting the terminal housing on the vent conduit.

8. The ventilator apparatus of claim 7 wherein the terminal housing further comprises:

a second bearing means secured to the vent conduit; and a plurality of third spider members operably disposed between the second bearing means and the inner conduit of the housing, the second bearing means rotatably engaging and supporting the opposed second end portion of the sleeve.

9. The ventilator apparatus of claim 8 wherein the terminal housing further comprises a plurality of fourth spider members operably disposed between the sleeve and the second end portion of the first terminal duct for maintaining the second end portion of the first terminal duct in a fixed spatial relationship with the sleeve.

10. The ventilator apparatus of claim 9 which further comprises:

a first screen transversely disposed in the first end portion of the first terminal duct; and a second screen transversely disposed in the second end portion of the second terminal duct, the first and second screens operating to prevent insects, debris and other foreign particles from entering the interior areas of the structure via the first and second terminal ducts.

11. The ventilator apparatus of claim 10 which further comprises:

cap means secured to the first end portion of the vent conduit for covering the vent conduit, the cap means being adapted to allow odors passing through the vent conduit to be discharged therefrom.

12. The ventilator apparatus of claim 11 wherein the cap comprises:

a lower body member having an aperture therein; and an upper body member, the upper body member operably connected to the lower body member such that air flow is established between the upper body member and the lower body member, the aperture of the lower body member being adapted to receive the first end portion of the vent conduit such that in an assembled position the lower body member is secured to the first end portion of the vent conduit.

13. The ventilator apparatus of claim 12 wherein said means for orienting the terminal housing is a vane member, the vane member being secured to the second terminal duct such that the vane member and the second end portion of the second terminal duct are substantially aligned.

14. The ventilator apparatus of claim 13 which further comprises air circulating means operably disposed in the inner passageway of the housing for causing air to enter the first terminal duct of the terminal housing and circulate into the second interior portion of the structure via the inner passageway.

15. The ventilator apparatus of claim 14 which further comprises heating means operably disposed in the inner passageway of the housing for selectively heating air circulating into the second interior portion of the structure via the inner passageway of the housing.

16. The ventilator apparatus of claim 15 wherein the structure is an underground structure.

17. The ventilator apparatus of claim 1 which further comprises a duct assembly operably disposed within the structure for circulating air through the structure, the duct assembly operably connected to and in fluid communication with the axially disposed inner passageway and the axially disposed outer passageway of the housing.

18. The ventilator apparatus of claim 17 wherein the duct assembly comprises an air inlet duct, an air return duct, and a plurality of damper assemblies, the air inlet duct operably connected to the housing such that fluid communication is established between the inner passageway of the housing and the second interior portion of the structure via the air inlet duct, the air return duct operably connected to the housing such that fluid communication is established between the outer passageway of the housing and the first interior portion of the structure via the air return duct, and the damper assemblies are operably disposed in the air inlet duct and the air return duct, each of the damper assemblies movable between a first position and a second position, the damper assemblies cooperating to selectively direct the flow of air through the structure via the air inlet duct of the air return duct.

19. The ventilator apparatus of claim 18 wherein the duct assembly further comprises an air conditioner unit operably connected to the air inlet duct.

20. The ventilator apparatus of claim 19 wherein the duct assembly further comprises a by pass duct, the by pass duct operably connected to and in fluid communication with the air inlet duct such that the flow of air through the air inlet duct can be selective diverted around the air conditioning unit via the by pass duct.

21. The ventilator apparatus of claim 20 wherein the duct assembly further comprises a filter operably disposed in the by pass duct.

22. The ventilator apparatus of claim 20 wherein the plurality of damper assemblies comprise a first damper assembly, a second damper assembly and a third damper assembly, the first damper assembly operably disposed in the air inlet duct such that in the first position the first damper assembly closes the by pass duct and directs the air flow through the air conditioner unit, in the second position the first damper assembly closes a portion of the air inlet duct to prevent air flow passing through the air conditioning unit and directs the air flow through the by pass duct; the second damper assembly operably disposed in the air inlet duct such that in the first position the second damper assembly closes the by pass duct such that the air flow through the air conditioner unit and the air inlet duct is unrestricted, in the second position the second damper assembly closes a portion of the air inlet duct to prevent the air flow from passing through the air conditioner unit and thus directs the air flow into the first interior portion of the structure via the by pass duct and the air inlet duct; and the third damper assembly operably disposed within the air return duct such that in the first position the air flow through the air return duct is directed into outer passageway of the housing, in the second position the third damper assembly closes a portion of the air return duct, prevents the air flow through the outer passageway of the housing, and directs the air flow into the air conditioning unit.

23. a ventilator apparatus for venting objectionable odors from an interior area of a structure to the atmosphere, the interior area of the structure having an upper portion and a lower portion, the ventilator apparatus comprising:

a first cylindrical housing having a first end portion and a second end portion, the first cylindrical housing being vertically positioned on the structure such that the first end portion of the first cylindrical housing extends upwardly from the structure and the second end portion of the first cylindrical housing extends into an upper portion of the interior area of the structure;

a second cylindrical housing having a first end portion and a second end portion, the second cylindrical housing being coaxially disposed within the first cylindrical housing such that a first passageway is formed therebetween, the first passageway establishing fluid communication between the upper portion of the interior area of the structure and the atmosphere;

a vent conduit having a first end portion, a medial portion, and a second end portion, the medial portion of the vent conduit being coaxially disposed within the second cylindrical housing such that a second passageway is formed therebetween, the second passageway establishing fluid communication between the upper portion of the interior area of the structure and the atmosphere, the first end portion of the vent conduit extending a distance from the first end portion of the first and second cylindrical housings, the second end portion of the vent conduit extending a distance from the second end portions of the first and second cylindrical housings and into the lower portion of the interior area of the structure, the vent conduit establishing fluid communication between the lower portion of the interior area of the structure and the atmosphere;

a terminal housing having an inlet and an outlet, the inlet being positioned in the terminal housing substantially opposite the outlet such that the inlet and outlet face in opposite directions, the terminal housing being rotatably mounted to the first end portion of the vent conduit and encompassing the first end portion of the first and second cylindrical housings such that in an assembled position the vent conduit communicates with the atmosphere, the inlet of the terminal housing communicates with one of the first and the second passageways and the outlet of the terminal housing communicates with the other of the first and the second passageways, the inlet and outlet of the terminal housing having a common central axis, the central axis being substantially perpendicular to a central vertical axis of the first cylindrical housing, the second cylindrical housing and the portion of the vent conduit disposed within the second cylindrical housing; and means secured to the terminal housing for orienting the terminal housing such that the inlet of the terminal housing faces the wind.

24. The ventilator apparatus of claim 23 wherein the terminal housing comprises:

a first terminal duct having a first end portion and a second end portion, the first end portion having the inlet positioned therein, the second end portion being disposed within an upper portion of the second passageway; and a second terminal duct having a first end portion and a second end portion, the first end portion having the outlet positioned therein, the second end portion encompassing an upper end portion of the first cylindrical housing.

25. The ventilator apparatus of claim 24 which further comprises a plurality of first spider members disposed between and secured to the vent conduit and the second cylindrical housing for maintaining the second cylindrical housing in a predetermined spatial relationship with the vent conduit.

26. The ventilator apparatus of claim 25 which further comprises a plurality of second spider members disposed between and secured to the first cylindrical housing and the second cylindrical housing for maintaining the first cylindrical housing in a predetermined spatial relationship with the second cylindrical housing.

27. The ventilator apparatus of claim 26 wherein the terminal housing further comprises a sleeve having a first end portion, an opposed second end portion, and a bore, the sleeve being vertically disposed within the first terminal duct of the terminal housing such that in the assembled position the first end portion of the vent conduit is positioned within the bore of the sleeve and extends outwardly from the first end portion of the sleeve.

28. The ventilator apparatus of claim 27 wherein the terminal housing further comprises a first bearing means secured to the first end portion of the sleeve for rotatably mounting and supporting the terminal housing on the vent conduit.

29. The ventilator apparatus of claim 28 wherein the terminal housing further comprises:

a second bearing means secured to the vent conduit; and a plurality of third spider members operably disposed between the second bearing means and the second cylindrical housing, the second bearing means rotatably engaging and supporting the opposed second end portion of the sleeve.

30. The ventilator apparatus of claim 29 wherein the terminal housing further comprises a plurality of fourth spider members operably disposed between the sleeve and the second end portion of the first terminal duct for maintaining the opposed second end portion of the first terminal duct in a fixed spatial relationship with the sleeve.

31. The ventilator apparatus of claim 30 which further comprises:

a first screen transversely disposed in the first end portion of the first terminal duct; and a second screen transversely disposed in the first end portion of the second terminal duct, the first and second screens cooperating to prevent insects, debris and other foreign particles from entering the interior area of the structure via the first and second terminal ducts.

32. The ventilator apparatus of claim 31 which further comprises:

a cap assembly secured to the first end portion of the vent conduit for covering the vent conduit, the cap assembly being adapted to allow odors passing through the vent conduit to be discharged therefrom.

33. The ventilator apparatus of claim 32 wherein the cap assembly comprises:

a lower body member having an aperture therein; and an upper body member, the upper body member operably connected to the lower body member such that air flow is established between the upper body member and the lower body member, the aperture of the lower body member being adapted to receive the first end portion of the vent conduit such that in an assembled position the lower body member is secured to the first end portion of the vent conduit.

34. The ventilator apparatus of claim 33 wherein said means for orienting the terminal housing is a vane member, the vane member being secured to the second terminal duct such that the vane member and the second end portion of the second terminal duct are substantially aligned.

35. The ventilator apparatus of claim 34 which further comprises air circulating means operably disposed in the second passageway for causing air to enter the first terminal duct of the terminal housing and circulate into the upper portion of the structure via the second passageway.

36. The ventilator apparatus of claim 35 which further comprises heating means operably disposed in the second passageway for selectively heating air circulating into the upper portion of the structure via the second passageway of the housing.

37. The ventilator apparatus of claim 36 wherein the structure is an underground structure.

38. The ventilator apparatus of claim 23 which further comprises a duct assembly operably disposed within the structure for circulating air through the structure, the duct assembly operably connected to and in fluid communication with the axially disposed inner passageway and the axially disposed outer passageway of the housing.

39. The ventilator apparatus of claim 38 wherein the duct assembly comprises an air inlet duct, an air return duct, and a plurality of damper assemblies, the air inlet duct operably connected to the housing such that fluid communication is established between the inner passageway of the housing and a second interior portion of the structure via the air inlet duct, the air return duct operably connected to the housing such that fluid communication is established between the outer passageway of the housing and a first interior portion of the structure via the air return duct, and the damper assemblies are operably disposed in the air inlet duct and the air return duct, each of the damper assemblies movable between a first position and a second position, the damper assemblies cooperating to selectively direct the flow of air through the structure via the air inlet duct of the air return duct.

40. The ventilator apparatus of claim 39 wherein the duct assembly further comprises an air conditioner unit operably connected to the air inlet duct.

41. The ventilator apparatus of claim 40 wherein the duct assembly further comprises a by pass duct, the by pass duct operably connected to and in fluid communication with the air inlet duct such that the flow of air through the air inlet duct can be selective diverted around the air conditioning unit via the by pass duct.

42. The ventilator apparatus of claim 41 wherein the duct assembly further comprises a filter operably disposed in the by pass duct.

43. The ventilator apparatus of claim 41 wherein the plurality of damper assemblies comprise a first damper assembly, a second damper assembly and a third damper assembly, the first damper assembly operably disposed in the air inlet duct such that in the first position the first damper assembly closes the by pass duct and directs the air flow through the air conditioner unit, in the second position the first damper assembly closes a portion of the air inlet duct to prevent air flow passing through the air conditioning unit and directs the air flow through the by pass duct; the second damper assembly operably disposed in the air inlet duct such that in the first position the second damper assembly closes the by pass duct such that the air flow through the air conditioner unit and the air inlet duct is unrestricted, in the second position the second damper assembly closes a portion of the air inlet duct to prevent the air flow from passing through the air conditioner unit and thus directs the air flow into the first interior portion of the structure via the by pass duct and the air inlet duct; and the third damper assembly operably disposed within the air return duct such that in the first position the air flow through the air return duct is directed into outer passageway of the housing, in the second position the third damper assembly closes a portion of the air return duct, prevents the air flow through the outer passageway of the housing, and directs the air flow into the air conditioning unit.

* * * * *